United States Patent [19]

Hirafuji

[11] 3,943,541

[45] Mar. 9, 1976

[54] LIQUID DEVELOPING APPARATUS FOR ELECTROPHOTOGRAPHY

[75] Inventor: Van Hirafuji, Yokohama, Japan

[73] Assignee: Ricoh Co., Ltd., Tokyo, Japan

[22] Filed: Oct. 11, 1973

[21] Appl. No.: 405,438

[30] Foreign Application Priority Data

Oct. 21, 1972 Japan ..... 47-105704

[52] U.S. Cl. ..... 354/318; 118/DIG. 23; 355/10; 427/15

[51] Int. Cl.[2] ..... G03D 5/00

[58] Field of Search ..... 354/297, 317, 318, 331, 354/339; 118/DIG. 23; 355/10; 117/37 LE; 427/15, 16, 17

[56] References Cited

UNITED STATES PATENTS

| | | | |
|---|---|---|---|
| 3,000,289 | 9/1961 | Horiuchi | 354/339 X |
| 3,104,603 | 9/1963 | Schwienbacher | 354/318 |
| 3,169,887 | 2/1965 | York | 118/DIG. 23 |
| 3,570,456 | 3/1971 | Marlor et al. | 118/637 |
| 3,596,635 | 8/1971 | Smitzer | 354/318 X |
| 3,635,144 | 1/1972 | Beck | 354/317 |
| 3,733,124 | 5/1973 | Tanaka et al. | 355/10 |
| 3,788,844 | 1/1974 | Sato et al. | 117/37 LE X |

*Primary Examiner*—Fred L. Braun

*Attorney, Agent, or Firm*—Cooper, Dunham, Clark, Griffin & Moran

[57] ABSTRACT

A developing apparatus in which a developing solution is caused to flood through a multiplicity of small apertures in an apertured plate to produce a uniform flow over the plate and is then caused to flow in the direction of travel of a sheet to be developed by use of a drawing roller rotating at a comparatively high speed immediately adjacent to an edge of the plate forming a layer of developing solution to contact only the exposed or recording surface of the sheet which is fed into the apparatus for development.

9 Claims, 8 Drawing Figures

LIQUID DEVELOPING APPARATUS FOR ELECTROPHOTOGRAPHY

BACKGROUND OF THE INVENTION

The invention relates to a wet developing process for electrophotography and an apparatus therefor.

While both dry and wet developing means are known for electrophotography, i.e., electrostatic photography and electrostatic recording, the invention is particularly concerned with a wet developing process and apparatus therefor in which a developing solution is used as a developer.

The conventional wet developing process using a developing solution comprises maintaining a supply of the developing solution in a dish-shaped vessel into which an exposed photosensitive or recorded recording sheet is fed for passage through the developing solution to effect the developing process, or comprises flushing a developing solution across an exposed photosensitive or recorded recording sheet which is fixed.

However, in such developing techniques, the developing solution is supplied to both surfaces of the sheet to be developed, namely, the photosensitive surface (the surface of a photoconductive layer) or the recording surface (the surface of an induction layer) which has been exposed or recorded as well as the rear surface, which results in the disadvantage of marring the rear surface of the sheet due to the attachment thereto of the developer.

In a wet developing process, the developing solution must be well stirred before it is supplied to the sheet. This is because the developing solution is used as the carrier for a toner powder mixed therein as is known, so that unless it is well stirred upon developing, there cannot be achieved a uniform supply of toner powder to the surface to be developed, which results in the non-uniformity of development. For these reasons, it is established that the higher the speed of relative movement between the developing solution and the surface to be developed, the better the result obtained. On the other hand, it is apparent that only one surface of the sheet need be developed. Consequently, the supply of the developing solution to both surfaces is wasteful.

SUMMARY OF THE INVENTION

The present invention provides a developing process for electrophotography and an apparatus therefor that overcomes the above disadvantages and is capable of supplying a well stirred developing solution to only one surface of the sheet which represents the surface to be developed. In accordance with the invention, a stirred developing solution is supplied in a flow condition to a moving surface to be developed. This results in a substantially high speed of relative movement between the developing solution and the surface to be developed, thereby increasing the amount of toner supplied per unit time. It also permits the completion of development within a short time interval, with the concomitant effect that the distance across which the surface to be developed is brought into contact with the developing solution is reduced. The supply of the developing solution to only one surface of the sheet which represents the surface to be developed prevents not only a waste of the developing solution, but also the marring of the rear surface of the sheet since the developing solution is not supplied thereto. The developing solution to be supplied is pumped by means of a pump, whereby it is subjected to a stirring action to permit fresh developing solution having a uniform toner concentration to be supplied to the surface to be developed. This assures a favorable developing result free from non-uniformity of development.

In the apparatus according to the invention, used developing solution is scraped off the periphery of a developer drawing roller by means of a cleaning member, thereby permitting a supply of fresh developing solution to be continuously offered to the surface to be developed.

DETAILED DESCRIPTION OF PREFERRED EMBODIMENTS OF THE INVENTION

Figure 1:
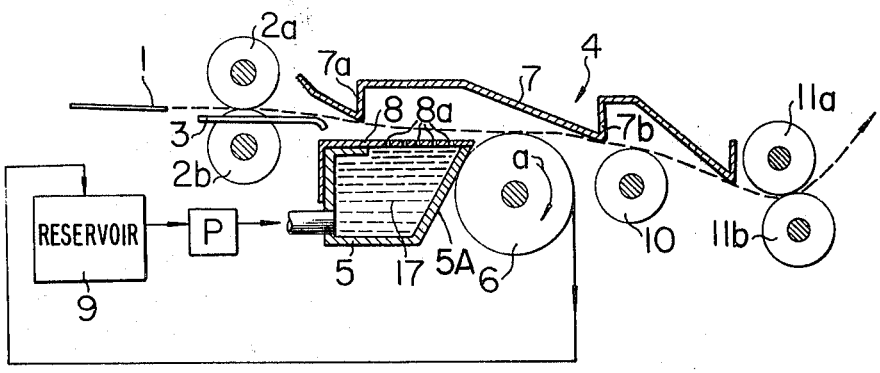
FIG. 1 is a schematic cross section showing one embodiment of the developing apparatus to which the invention is applied.

Referring to FIG. 1, a sheet 1 to be developed is formed with an electrostatic latent image by exposure to radiation or by stylus recording. A pair of upper and lower feed rollers 2*a*, 2*b* and a guide plate 3 are provided to feed the sheet into a developing apparatus 4, with the surface having the latent image positioned downwardly. The developing apparatus 4 comprises a tank 5 for supplying a developing solution, a developer drawing roller 6 located adjacent to the tank 5, and a guide plate 7 which constrains the sheet 1 fed into the apparatus 4 so as to bring its lower surface to be developed into contact with the developing solution.

Figure 2:
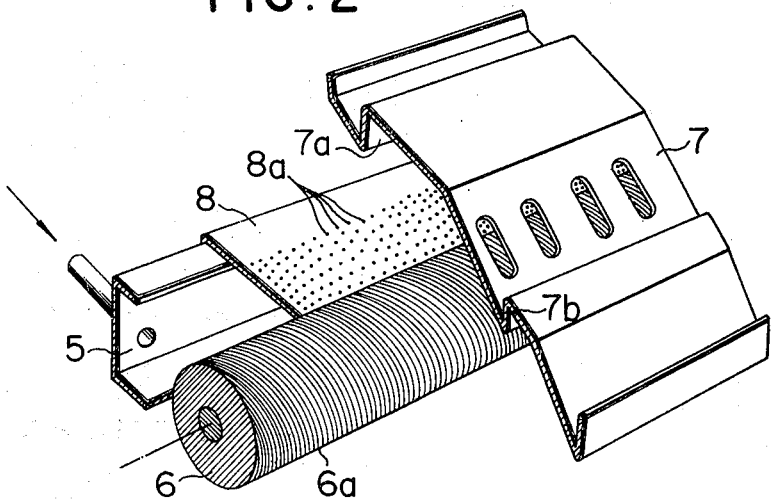
FIG. 2 is a perspective view of principal parts shown in FIG. 1.
Figure 3:
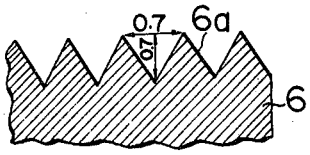
FIG. 3 is a cross section, to an enlarged scale, of V-shaped grooves formed around the developer drawing roller.

The tank 5 is in the form of a trough which extends transversely with respect to the direction of travel of the sheet 1 to be developed, and which has a side wall 5A and a top opening that is covered by an apertured plate 8. As shown in FIG. 2, the apertured plate 8 is formed with a multiplicity of small apertures 8*a* which may be 1 mm in diameter and distributed with a density of 10 to 30 per square centimeter. As an example, 25 such apertures may be provided per square centimeter. The tank 5 is supplied with a developing solution 17 from a developer reservoir 9 by means of a pump P. The developing solution 17 supplied by the pump P fills the tank 5 and is caused to flood through the small apertures 8*a* to the upper side of the apertured plate 8. The developer drawing roller 6 is located adjacent to the supply tank 5 on the side thereof which is advanced as viewed in the direction of travel of the sheet 1 to be developed. The roller 6 is driven for rotation, in the direction indicated by an arrow *a*, at a speed higher than the speed with which the sheet 1 is transported within the developing apparatus 4, for example, at a speed which is 2.5 times the transport speed. As shown in FIG. 2, the roller 6 is peripherally formed with a number of shallow V-shaped grooves 6*a* in the form of a helix having a close pitch. The V-shaped grooves 6*a* extend at a right-hand thread with an angle of inclination of about 30°. As shown in FIG. 3, both the pitch and the depth of the grooves may be on the order of 0.7 mm, for example. The V-shaped grooves 6*a* serve to retain the developing solution on the periphery of the roller 6. A delivery roller 10 is located to the right of the developer drawing roller 6, or spaced therefrom in the direction of travel of the sheet being developed. The guide plate 7 extends over the supply tank 5, developer drawing roller 6 and the delivery roller 10, and includes a depending portion 7*a* which extends toward the supply tank 5 and another depending portion 7*b* which extends toward the delivery roller 10. Both depending portions 7*a* and 7*b* serve to press down the rear surface of the sheet 1 being developed for contact of its surface to be developed with the developing solution.

In operation, as the developing solution 17 is supplied from the reservoir 9 to the supply tank 5 through the pump P, the solution 17 fills the tank 5 and is caused to flood through the small apertures 8*a* to the upper side of the apertured plate 8. The flood of developing solution 17*a* (See FIG. 5) is drawn around the periphery of the drawing roller 6 which is rotating at high speed, thereby forming a layer of developing solution 17*b* on the periphery of the roller. That portion 17*c* (See FIG. 5) of the developing solution which is shown falling off the periphery of the roller 6 is recovered to be returned to the reservoir 9. Thus the developing solution 17 is placed in circulation along the path comprising the reservoir 9, pump P, supply tank 5, small apertures 8*a*, the periphery of the developer drawing roller 6, and the reservoir 9, and is sufficiently stirred in the process of being supplied by the pump P to the supply tank 5.

When a sheet 1 to be developed is fed, with its surface to be developed positioned downwardly into the developing apparatus 4 which operates in this manner, the rear surface of the leading portion of the sheet 1 is initially constrained by the depending portion 7*a*, whereby the surface to be developed of the sheet 1 is brought into contact with the developing solution 17*a* which is flooding through the small apertures 8*a*, and is then fed toward the developer drawing roller 6. Subsequently, the surface to be developed moves in contact with the layer of developing solution 17*b* (See FIG. 5) formed on the periphery of the developer drawing roller 6, and is thereafter fed toward the delivery roller 10. During the process, the developing solution is supplied only to one surface of the sheet which represents the surface to be developed, thus effecting development of such surface. The sheet 1 fed toward the delivery roller 10 is prevented from lifting up by the depending portion 7*b*, so that the sheet 1 is continuously pressed down by both depending portions 7*a* and 7*b*, causing the surface to be developed during movement to be maintained in contact with the layer of developing solution 17*b* on the developer drawing roller as well as the flood of developing solution 17*a* on the apertured plate 8. After being fed by the delivery roller 10, the developed sheet is carried out of the apparatus by a pair of upper and lower discharge rollers 11*a*, 11*b*.

Figure 4:
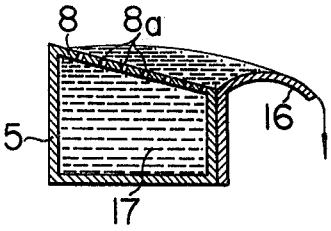
FIG. 4 is a cross section showing another embodiment of the developing apparatus to which the invention is applied.

While in the above described embodiment, the developing solution 17*a* which has uniformly flooded through the multiplicity of small apertures 8*a* in the apertured plate 8 has been caused to flow only in the direction of travel of the sheet to be developed by the arrangement of the developer drawing roller 6 adjacent to the supply tank 5 and driving it at a rotational speed greater than the transport speed of the sheet, such flow can also be established by an inclined disposition of the apertured plate 8 as will be described below. Thus, referring to FIG. 4 which shows another embodiment, the apertured plate 8 having a multiplicity of small apertures 8*a* formed therein is disposed in an inclined configuration falling downward in the direction of travel of the sheet to be developed. A developer guide plate 16 in the form of an arc in section is located adjacent plate 8, with the uppermost surface of the arc-shaped guide plate 16 being positioned above the falling end of the apertured plate 8. In this manner, the developing solution which floods through the multiplicity of small apertures 8*a* is caused to flow in the direction of travel of the sheet to be developed along the inclined surface of the apertured plate 8. As a result, a layer of developing solution is formed on the upper surface of the apertured plate 8 and the guide plate 16 for contact with the sheet surface to be developed. After passing over the guide plate 16, the developing solution is collected for circulation to the reservoir 9 as in the previous embodiment.

Alternatively, instead of disposing the apertured plate 8 in an inclined configuration to determine the direction of flow of the developing solution, it will be appreciated that the apertured plate 8 may be left in a horizontal disposition and surrounded by weirs along its three sides with one side aligned with the desired direction of flow of the developing solution left open.

While in the embodiments described above, the depending portions 7*a* and 7*b* which serve to press down the rear surface of the sheet to be developed are formed by bending a single sheet of plate, it will be appreciated that such depending portions 7*a*, 7*b* may be formed by separate members.

Figure 5:
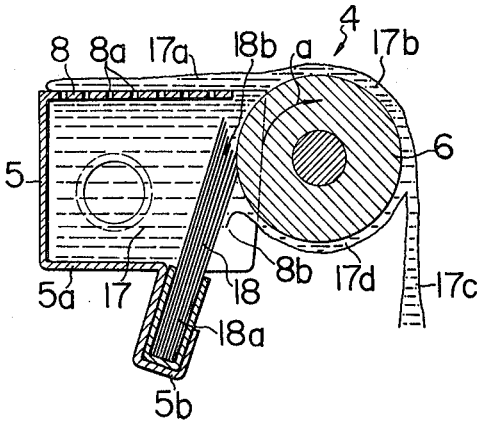
FIG. 5 is a cross section showing a further embodiment of the apparatus according to the invention in which a cleaning member is added to the developer drawing roller.

A compact apparatus for developing one surface of the sheet can be obtained when the supply tank 5 and the developer drawing roller 6 are arranged as shown in FIG. 5. Specifically, the side wall 5*a* of the supply tank 5 which is located adjacent to the roller 6 is removed to provide an opening 8*b* into which the roller 6 is partially placed, thereby reducing the dimension of the apparatus in the direction of travel of the sheet 1. However, with such an arrangement, because of the high speed at which the roller 6 rotates, there is a likelihood that a portion 17*d* of the developing solution 17*c*, which normally falls off the roller after use to be returned to the reservoir 9, continues rotating with the roller to thereby circulate along the periphery of the roller rather than being freed therefrom. Such circulation results in a decreased toner concentration in the developing solution supplied to the supplying station because the developing solution once used in the developing process is returned to the developing station again along the surface of the roller 6. In addition, when developing a latent image surface formed on an elongate sheet with a developing solution mixed with toner powder which is in a still condition, a satisfactory developing effect can not be achieved on the later half of the sheet. This is because the toner in the developing solution which is in contact with the latent image portion becomes insufficient for the later half.

These drawbacks are avoided in the apparatus according to the invention through a sophisticated use of a cleaning member. Specifically, referring to FIG. 5, a portion 17*d* of the developing solution which has been used in the developing process and which remains attached to the periphery of the developer roller 6 is scraped off by a cleaning member 18 which is disposed within the supply tank 5. The cleaning member 18 comprises a brush having its base 18*a* retained by a support 5*b* which may be formed by folding the bottom plate 5*a* of the supply tank 5 into a U-shaped section. The free end of the cleaning member 18 extends into the developing solution 17 within the tank 5, and its forward end 18*b* abuts against the periphery of the roller 6 in the region of the opening 8*b* within the tank 5 and cooperates with the roller 6 in forming the side wall.

By using the cleaning member 18 thus constructed, a portion 17*d* of the used developing solution, which moves around with the periphery of the roller 6 as it rotates, is scraped off by the forward end 18*b* of the brush before it reaches the layer of developing solution 17*b* formed on top of the roller 6. Thus, the periphery of the roller 6 is cleaned and a fresh layer of developing solution 17*b* is formed on its periphery by the supply of a fresh developing solution over the forward end 18*b* of the brush as well as by the supply of the developing solution flooding through the apertured plate 8.

Figure 6:
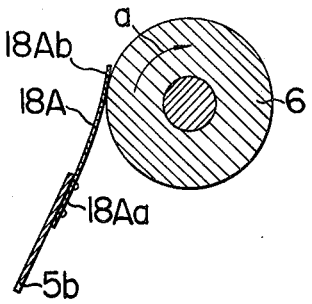
Figure 7:
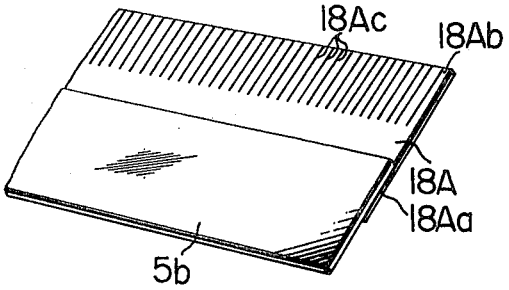

FIG. 6 shows another example in which the cleaning member 18 is formed of a film 18A of polyester, such as Mylar (trademark) or the like, and its base 18A*a* is mounted on a support member 5*b* while its forward end 18A*b* is held in abutting relationship with the periphery of the roller 6. Desirably, the forward end 18A*b* of the cleaning member 18A is formed with a number of cuts 18A*c* as shown in FIG. 7. This is because it is preferred to form the forward end 18A*b* of the cleaning member 18A in the form of a brush in order to assure abutment against the grooved periphery of the roller in view of the fact that the roller 6 is formed with V-shaped grooves 6*a* (See FIGS. 2 and 3) for the purpose of supplying the developing solution.

While the cleaning member 18 or 18A is positioned within the supply tank 5 in the above examples, such cleaning member 18 or 18A may be positioned at any location which is beyond the position at which the used developing solution 17*c* falls off the roller into the reservoir 9, as viewed in the direction of rotation of the roller.

Figure 8:
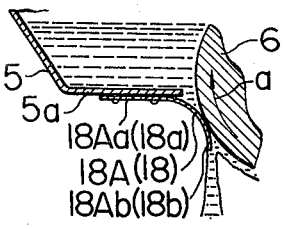
FIGS. 6, 7 and 8 are views illustrating other examples of the cleaning member.

Alternatively, the forward end 18A*b* (18*b*) of the cleaning member 18A (18) may extend in the opposite direction to the direction of rotation of the roller 6 when abutting thereagainst, as shown in FIG. 8. Specifically, the base 18A*a* (18*a*) of the cleaning member 18A (18) is mounted on the outside of the bottom plate 5*a* of the supply tank 5, and its forward end 18A*b* (18*b*) is extended toward the periphery of the roller 6 so as to abut thereagainst in a direction opposing the direction of rotation of the roller.

What is claimed is:

1. A developing apparatus for electrophotography comprising:

a. means for supplying a developing solution;

b. tank means, having at least one side wall, for holding the developing solution supplied by said supplying means and including at its top an apertured plate having an upper surface and a multiplicity of small apertures formed therein to permit the developing solution to flood through the apertures onto said upper surface in a uniform manner;

c. a developing roller located adjacent to the tank means with its surface disposed for directly receiving the flooding developing solution from said upper surface of the apertured plate and rotating at a peripheral speed greater than the speed at which a copy sheet having a surface to be developed is passed thereby; and d. a guide means for constraining the copy sheet so as to maintain the surface to be developed thereon in contact with the developing solution on the upper surface of the apertured plate and the surface of the roller while the sheet is being passed thereby.

2. A developing apparatus as in claim 1 wherein the apertured plate is formed with apertures of substantially 1 mm in diameter at a density from 10 to 30 per square centimeter.

3. Apparatus as in claim 1 wherein the surface of said developing roller forms at least part of said one side wall of said tank.

4. A developing apparatus for electrophotography comprising:

a. tank means, having at least one side wall, for retaining and supplying a developing solution;

b. an apertured plate at the top of said tank means having a multiplicity of small apertures formed therein to permit the developing solution to flood therethrough in a uniform manner;

c. supply means for causing said developing solution to flood said apertured plate;

d. a developing roller having a peripheral surface located adjacent to the tank means and driven for rotation at a peripheral speed greater than the speed at which a sheet having a surface to be developed is passed thereby for directly receiving said flooded developing solution from said apertured plate onto its peripheral surface at a first point in its rotational path so that a layer of developing solution is formed in a region defined across the apertured plate and the adjacent peripheral surface of the developing roller;

e. a guide plate for constraining the sheet so as to maintain the surface to be developed thereon in contact with the layer of developing solution which is supplied to the apertured plate and roller while the sheet is being passed thereby; and f. a cleaning member abutting against the peripheral surface of the developing roller at a second point in its rotational path prior to said first point for receiving said flooded developing solution for scraping off the developing solution which tends to return to said region moving with the surface of the developing roller.

5. A developing apparatus according to claim 4 in which the cleaning member comprises a brush.

6. A developing apparatus according to claim 4 in which only a portion of said cleaning member abuts the peripheral surface and wherein the cleaning member comprises a film of polyester having a number of cuts formed in the portion abutting against the peripheral surface of the developing roller.

7. Apparatus as in claim 4 wherein the surface of said developing roller forms at least part of said one side wall of said tank.

8. Apparatus as in claim 4 wherein said cleaning member forms at least part of said one side wall of said tank.

9. A developing apparatus for electrophotography comprising:

a. means for providing a supply of developing solution;

b. an apertured plate on said supply means having an upper surface with at least one edge and a multiplicity of small apertures formed therein to permit the developing solution to flood through the apertures onto said upper surface in a uniform manner;

c. a developer drawing roller means, having a peripheral surface with shallow V-shaped grooves in the form of a helix therein, disposed adjacent said one edge of said apertured plate and rotating at a peripheral speed greater than the speed at which a copy sheet having a surface to be developed is passed thereby, for drawing the developing solution which has flooded the upper surface of said apertured plate onto its peripheral surface to form a layer of developing solution across the apertured plate and said adjacent peripheral surface of said roller means; and d. means for bringing the surface of the copy sheet to be developed into contact with said layer of developing solution while the sheet is being passed thereby.

* * * * *